United States Patent [19]

Fujii et al.

[11] Patent Number: 4,991,406

[45] Date of Patent: Feb. 12, 1991

[54] AIR CONDITIONER

[75] Inventors: Eiichiro Fujii, Fuji; Kiyoshi Horimizu, Fujinomiya, both of Japan

[73] Assignee: Kabushiki Kaisha Toshiba, Kawasaki, Japan

[21] Appl. No.: 384,422

[22] Filed: Jul. 25, 1989

[30] Foreign Application Priority Data

Jul. 27, 1988 [JP] Japan ..... 63-98433[U]
Oct. 31, 1988 [JP] Japan ..... 63-142265[U]

[51] Int. Cl.[5] ..... F25D 19/00
[52] U.S. Cl. ..... 62/296; 62/259.1
[58] Field of Search ..... 62/236, 237, 324.1, 62/259.1, 296; 417/312

[56] References Cited

U.S. PATENT DOCUMENTS

| | | | |
|---|---|---|---|
| 1,895,806 | 1/1933 | Lipman | 62/296 X |
| 2,150,700 | 3/1939 | Philipp et al. | 62/296 |
| 2,177,827 | 10/1939 | Hintze | 62/296 |
| 2,247,950 | 7/1941 | Kucher | 62/296 |
| 2,250,648 | 7/1941 | Philipp | 62/296 X |
| 2,989,855 | 6/1961 | Thompson | 62/296 |
| 3,646,934 | 3/1972 | Foster | 62/296 X |
| 4,384,635 | 5/1983 | Lowery | 62/296 X |

FOREIGN PATENT DOCUMENTS 57-66424 4/1982 Japan .

*Primary Examiner*—Lloyd L. King
*Attorney, Agent, or Firm*—Oblon, Spivak, McClelland, Maier & Neustadt

[57] ABSTRACT

An air conditioner generally comprises a compressor accommodated in the outer casing thereof and the compressor is surrounded by a sound-proof cover. The sound-proof cover is formed of a main body made of a sound absorbing material and a heat insulating member preferably made of a foam of a thermosetting resin which is bonded to the surface of the main body opposing to the outer surface of the compressor. The heat insulating member has a heat transfer efficiency smaller than that of the main body. The main body is preferably formed of a sound absorbing member and a noise insulating member. The heat insulating member, the sound absorbing member and the noise insulating member are laminated and bonded to each other in this order. The entire sound-proof cover is arranged in contact with substantially the entire outer periphery of the compressor. An outer casing formed of a sound absorbing material may be further disposed so as to surround the sound-proof cover with space therebetween.

12 Claims, 5 Drawing Sheets

AIR CONDITIONER

BACKGROUND OF THE INVENTION

This invention relates to an air conditioner having a compressor the outer periphery of which is covered with a sound-proof cover and relates more particularly to an air conditioner having an improved sound-proof cover.

Conventional air conditioners of this type is designed to reduce noise generated from a compressor during operation by covering outer peripheral portions of the compressor with a cylindrical sound-proof cover which is spaced apart from the compressor.

In this type of conventional air conditioners, the sound-proof cover is formed of a sound-proof material such as felt having a thickness of about 5 to 15 mm, or a similar felt member with a polyvinyl chloride sheet adhered to the outer surface thereof. Felt is very cheap and is suitable for mass production, but it is inferior in terms of adiabatic and sound absorbing performances.

The heat insulating performance of the sound-proof cover is therefore inadequate in a case where the compressor is operated in a region where the outside temperature is low. As a result, the time taken to start supplying hot air after heating operation has been started is long.

The sound-proof cover reduces the heat radiation loss of the compressor and therefore entails a problem of a reduction in the operating efficiency, e.g., a problem of losses of heating power in a case where the compressor is pre-heated by wire heating or the like. Moreover, the conventional technique cannot provide an effective noise reduction means.

SUMMARY OF THE INVENTION

An object of this invention is to substantially eliminate the defects or drawbacks encountered to the prior art and to provide an air conditioner designed to improve the performance of insulating the heat of a compressor accommodated in the air conditioner.

Another object of this invention is to provide an air conditioner including an adiabatic sound-proof cover for a compressor accommodated in the air conditioner improved in adiabatic and sound absorbing performances and capable of limiting heat loss of the compressor as well as reducing noise.

These and other objects can be achieved according to this invention by an air conditioner generally comprising an outer casing in form of a rectangular box, a compressor accommodated in the outer casing, an inverter for controlling the operation of the compressor, a heat exchanger, and a fan for circulating an outdoor air in the casing of the air conditioner, the compressor being surrounded by a sound-proof cover comprising a main body and a heat insulating member provided for the outer surface of the main bodY so as to substantially cover the entire surface of the sound-proof cover, the heat insulating member having a heat transfer efficiency smaller than that of the main body.

In a preferred embodiment according to this invention, the main body of the sound-proof cover is formed of a sound absorbing member, preferably a felt member, and a noise insulating member and the heat insulating is formed of a thermosetting resin foam, the thermosetting resin foam, the sound absorbing member and the noise insulating member being laminated in this order with the thermosetting resin foam opposing to the outer surface of the compressor.

According to the air conditioner of this invention of the character described above, a heat insulating member is attached to the inner surface of the sound-proof cover covering the periphery of the compressor so as to shut off the heat radiation from the outer peripheral portion of the compressor, thereby enabling a remarkable reduction in the heat loss as well as an improvement in the performance of insulating the heat of the compressor.

It is therefore possible to increase the speed with which the heating operation of the air conditioner is started.

The sound-proof cover is constituted by a sound absorbing member and a noise isolating member in form of laminated layers, thereby remarkably reducing the heat loss of the compressor and the magnitude of noise generated therefrom.

A foam of a thermoset forming an adiabatic layer is bonded to one face of a felt member provided as a sound absorbing member and a noise insulating member is laminated and bonded to the other face of the felt member, thereby eliminating the need for any dust prevention means, e.g., applying vinyl acetate to the surface of the felt member in order to prevent fiber dust from generating from the felt surface, and thereby improving the workability of the operation of attaching the sound-proof cover to the compressor.

DESCRIPTION OF THE PREFERRED EMBODIMENTS

Preferred embodiments of this invention will be described below with reference to the accompanying drawings.

Figure 8:
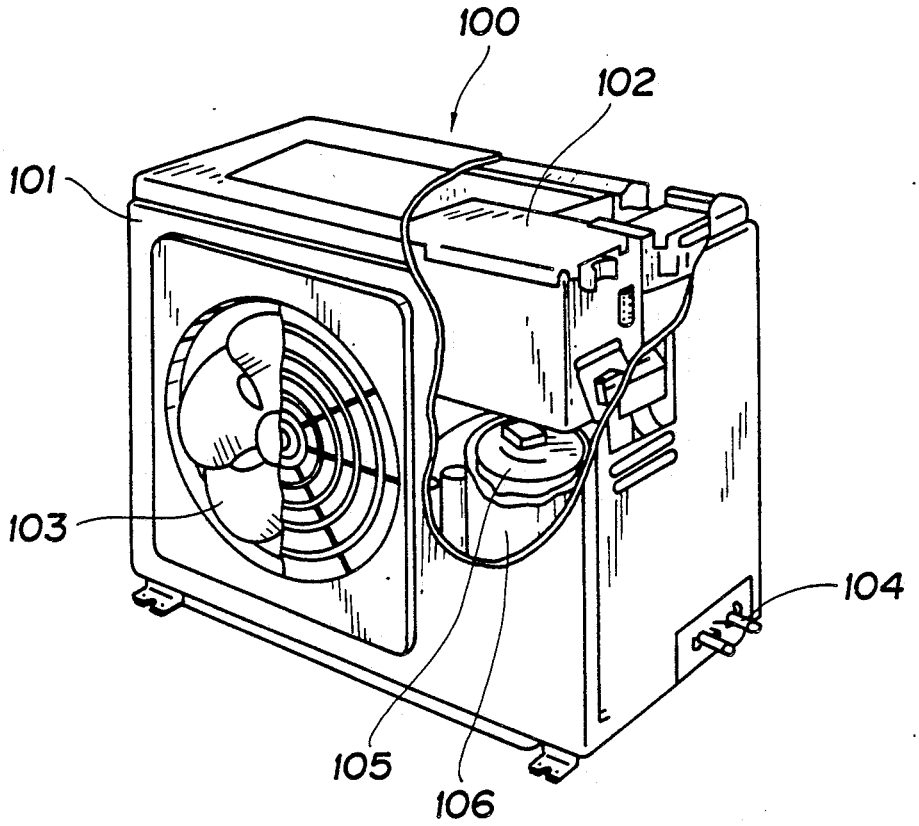
FIG. 8 is a partially cutaway perspective view of an outdoor unit of an air conditioner to which this invention is applied.

FIG. 8 shows an embodiment representing an example of application of this invention to an outdoor unit a of a split type air conditioner capable of being freelY changed over to select cooling or heating operation, part of the outdoor unit being removed. The outdoor unit 100 has a unit casing 101 in the form of a rectangular box and incorporates therein a compressor 105 and an inverter 102 for controlling the operating speed of the compressor 1. The compressor 105 is surrounded by a sound-proof cover 106. Referring to FIG. 8, a reference character 103 indicates an outdoor fan and a reference character 104 indicates a packed valve.

Figure 9:
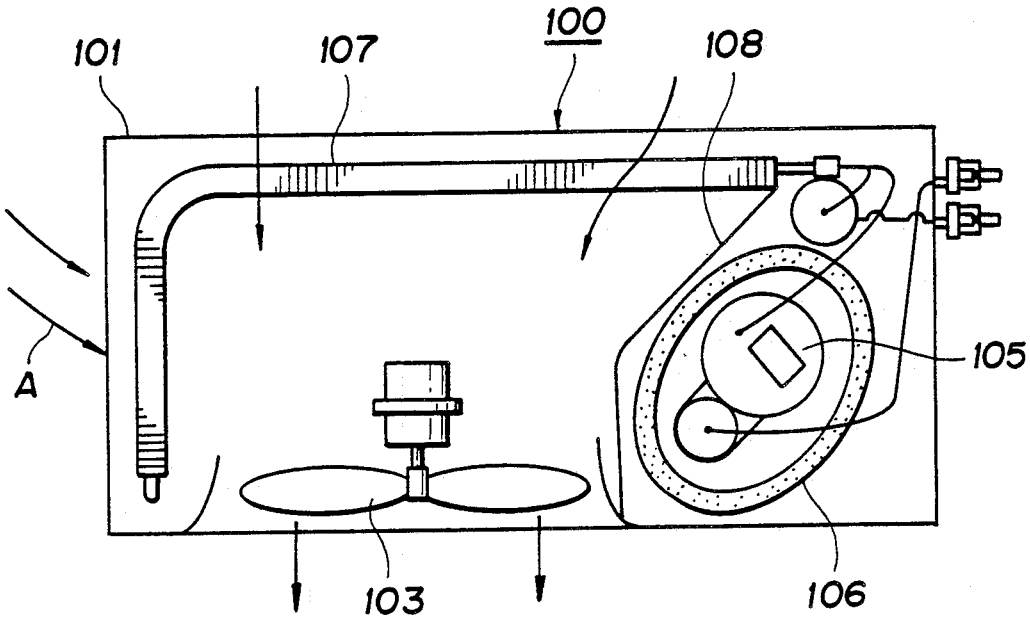
FIG. 9 is a brief plan view of an air conditioner of the type shown in FIG. 8.

FIG. 9 shows a plan view of the air conditioner 100 of the type shown in FIG. 8 briefly showing an arrangement of members or elements accommodated in the air conditioner 100. Referring to FIG. 9, a heat exchanger 107 is located near and along the casing 101 and the fan 103 is also located inside the heat exchanger 107. An arrow A designates the flow of an outdoor air by the operation of the fan 103. The compressor 105 is separated by a partition plate 108 from the heat exchanger 107 and the fan 103. The compressor 105 of generally cylindrical shape is surrounded by a sound-proof cover 106 with a slight space therebetween.

It should of course be noted that the indoor arrangement of the air conditioner is not limited to the illustrated example.

Figure 1:
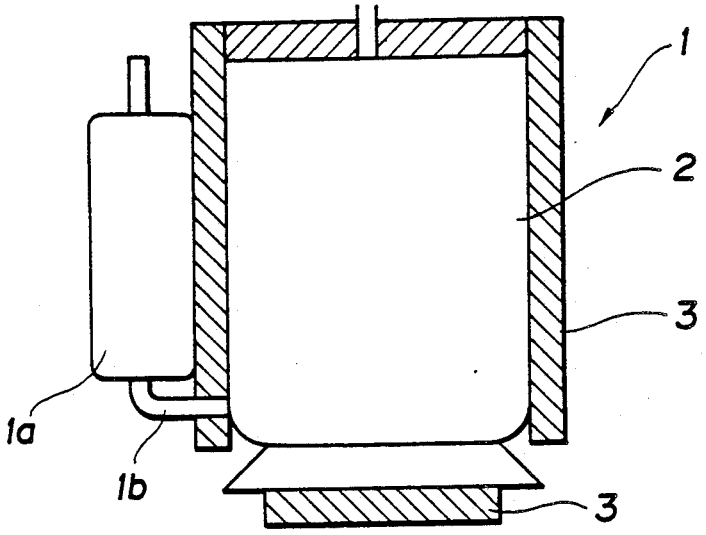
FIG. 1 is a sectional view of a sound-proof cover in accordance with this invention illustrating a state in which the sound-proof cover is applied to the compressor.
Figure 2:
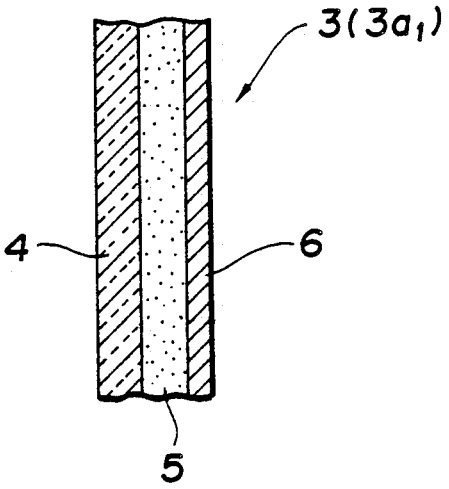
FIG. 2 is a cross-sectional view of a portion of the sound-proof cover shown in FIG. 1.

Referring to FIG. 1 showing a compressor 1 which is surrounded by a noise-proof cover 3 comprising three parts which are attached to peripheral portions (upper, lower and side surfaces) of the casing 2 of the compressor 1 so as to surround the compressor 1. As shown in FIG. 2, the sound-proof cover 3 is formed by successively placing, as its inner to outer layers, a heat insulating member 4, a sound absorbing member 5 and a noise insulating member 6 one upon another.

Figure 3:
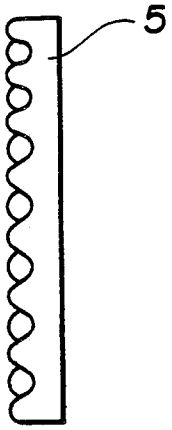
FIG. 3 is a brief illustration of a modification of an urethane foam of the sound-proof cover shown in FIG. 2.

The sound-proof cover 3 formed of the sound absorbing member 5 and the noise insulating member 6 may have a simple construction. That is, it is sufficient for the sound-proof cover 3 to have one of the sound absorbing member 5 and the noise insulating member 6. The heat insulating member 4 is formed of glass wool or a foam of a thermosetting resin because the temperature of the surface of the compressor 1 may be increased to 130° C. or higher. The sound absorbing member 5 is formed of an urethane foam which is cheap but has superior sound absorbing properties of a felt, or of an urethane foam member having the surface on the side of the heat insulating member 4 formed with generally wave-like irregularities so as to form a three-dimensional pattern as shown in FIG. 3. The noise insulating member 6 is formed of a rubber or polyvinyl chloride sheet having a low elastic modulus and a high specific gravity.

The operation of this embodiment will be described below.

If the sound-proof cover 3 formed by successively placing the heat insulating member 4, the sound absorbing member 5 and the noise insulating member 6 one upon another is attached to the outer periphery of the casing 2 of the compressor 1, the heat inside the compressor 1 is isolated by the heat insulating member 4 so that the heat loss is limited to a very small degree, and, at the same time, noise from the compressor is remarkably reduced by the sound absorbing member 5 and the noise insulating member 6. The operation of attaching the sound-proof cover 3 to the casing 2 of the compressor 1 can be performed with the same workability as in the case of the conventional arrangement.

Since the heat insulating member 4 formed of glass wool or a foam of a thermosetting resin is provided as the inner layer of the sound-proof cover 3, it is not necessary to improve the heat resistance of the sound absorbing member 5, thereby enabling an urethane foam which is cheap but improved in sound absorbing properties to be used as the sound absorbing member 5. Because the heat insulating member 4 has sound absorbing properties while the sound absorbing member 5 also has adiabatic properties, a synergic effect of the properties of these members can be achieved, which is more advantageous as compared with a case where each member is used independently.

The present invention is further advantageous in that the sound-proof cover can be designed to be of a heat-insulation-improved type or sound-absorption-improved type as desired by changing the thickness of each of the heat insulating member 4 and the sound absorbing member 5.

Conventionally, in a case where the sound absorbing member 5 is formed of a felt member, there is a problem of dispersion of fiber dust from the surface of the felt member. However, it is possible to prevent dispersion of fiber dust form the surface of the felt without using any particular dust-protection means by bonding, by an adhesive, a foam of a thermosetting resin to one face of the felt member and the noise insulating member 6 to the other face of the felt member. It is thereby possible to improve the workabilitY of the operation of attaching the sound-proof cover 3 to the compressor casing 2.

Referring to FIG. 1, reference numeral 1*a* designates a suction cup for the compressor 1 and the suction cup la is provided with a suction tube 1*b* connected to the compressor 1 through he sound-proof cover 3.

The comparison between the sound-proof cover 3 in accordance with the present invention and conventional sound-proof covers will be shown below for further understanding of the functions and effects described above. The conventional sound-proof covers used for comparison were a reference example (1') formed of a felt member having a thickness of 10 mm and a conventional example (2') constructed by successively placing, as the inner and outer layers thereof, a felt member having a thickness of 10 mm and a polyvinyl chloride sheet having a thickness of 3 mm one upon another. Examples of the noise-proof cover 3 in accordance with this invention were an example (1) constructed by successively placing from the inner side a melamine foam layer having a thickness of 10 mm, an urethane foam layer (with a three-dimensional pattern) having a thickness of 10 mm and a rubber layer having a thickness of 3 mm one upon another, an example (2) constructed by successively placing from the inner side a melamine foam layer having a thickness of 10 mm, an urethane foam layer having a thickness of 10 mm and a polyvinyl chloride sheet having a thickness of 3 mm one upon another, and an example (3) constructed by successively placing from the inner side a glass wool layer having a thickness of 10 mm, an urethane foam layer having a thickness of 10 mm and a rubber layer having a thickness of 3 mm one upon another. The thermal conductivity of the heat insulating member 4 is 0.06 Kcal/mh° C. when formed of felt, or 0.03 Kcal/mh ° C. when formed of glass wool or the thermoset. In these examples, a heat insulating member (0.06 Kcal/mh° C.) is additionally attached to the inner surface of the sound-proof cover 3 (sound absorbing member).

Figure 4:
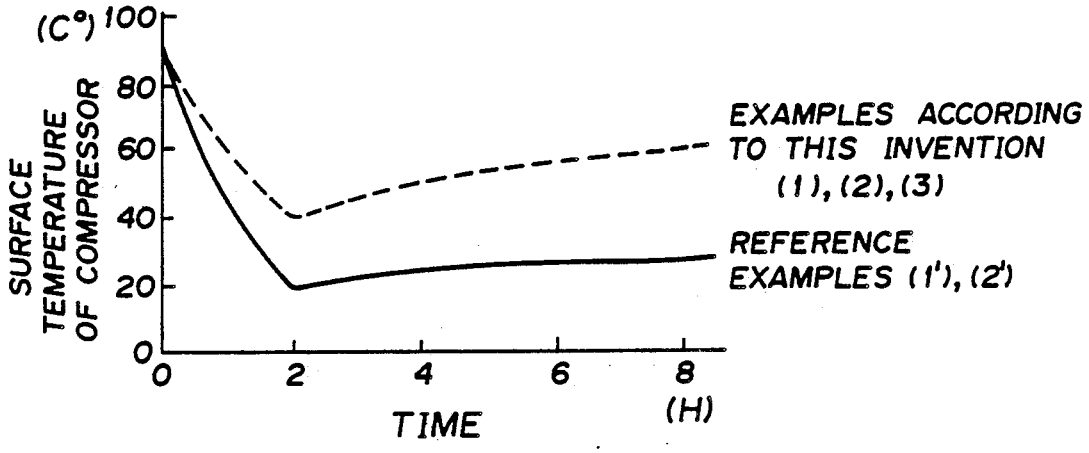
FIGS. 4 and 5 are graphs for comparison between sound-proof covers in accordance with this invention and conventional sound-proof covers.

FIG. 4 shows changes in the temperature of a surface of the compressor after the stoppage of heating operation of the air conditioner [ordinate: temperature of the compressor surface, abscissa: hours (H)]. These results were obtained under the condition that the ambient temperature of the outdoor heat exchanger was 0° C. and the compressor was supplied with power (input: 24.5 W) so as to be heated two hours after the stoppage of operation of the air conditioner. As a result of comparison between the sound-proof covers 3 in accordance with this invention and the conventional sound-proof cover 3, the compressor temperatures eight hours after the stoppage of air conditioner operation in the examples (1) to (3) according to this invention were higher than those in the reference examples (1') and (2') by 34° C., thus improving the adiabatic performance. The performance of starting the heating operation is thereby remarkably improved as shown in FIG. 4.

Figure 5:
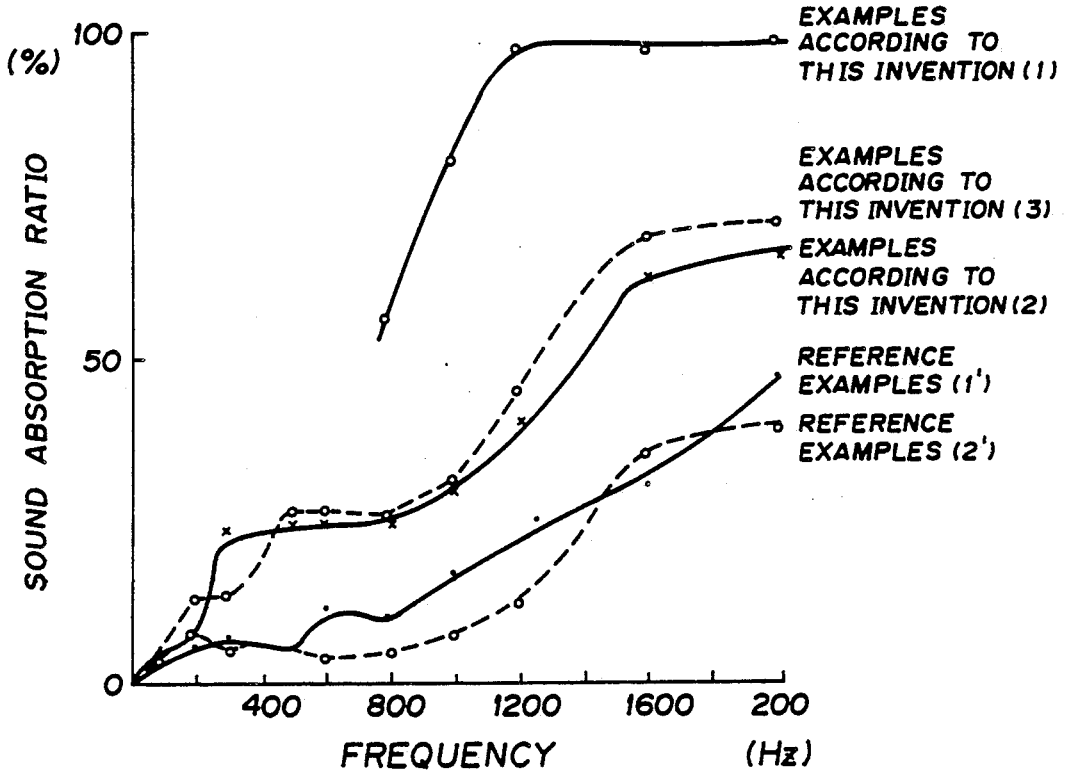

FIG. 5 shows the sound absorbing coefficient of the noise-proof cover with respect to frequencies of compressor noise [the ordinate: sound absorbing coefficient of the sound-proof cover (%), abscissa: frequencies of compressor noise (Hz)]. The noise was measured with respect to a range below 2000 Hz in which the degree of noise determined by the auditory sense is considerable. As a result of comparison between the sound-proof covers 3 in accordance with this invention and the conventional sound-proof cover 3, the sound absorbing coefficient of each of the examples (1) to (3) according to this invention was much higher than those of the reference examples (1') and (2'). Thus, the examples of this invention were also superior than the reference examples with respect to the noise reduction effects.

Thus, the heat loss of the compressor 1 can be limited to a very small degree while the performance of starting the heating operation of the air conditioner is remarkably improved. At the same time, the magnitude of noise from the compressor 1 can be remarkably reduced.

In accordance with the above-described embodiment, the sound-proof cover is formed by successively placing from the inner side a heat insulating member, a sound absorbing member and a noise insulating member one upon the other. In a case where the sound absorbing member is formed of an urethane foam with a three-dimensional pattern, the area of contact between this member and the heat insulating member is small. In this case, therefore, the sound-proof cover 3 may be of a two-part structure having a heat insulating layer and the sound absorbing member and the noise insulating member. In this arrangement, the workability of the operation of attaching the sound-proof cover 3 to the casing of the compressor can be improved while maintaining substantially the same effects as those attained by the above-described embodiment.

Figure 6:
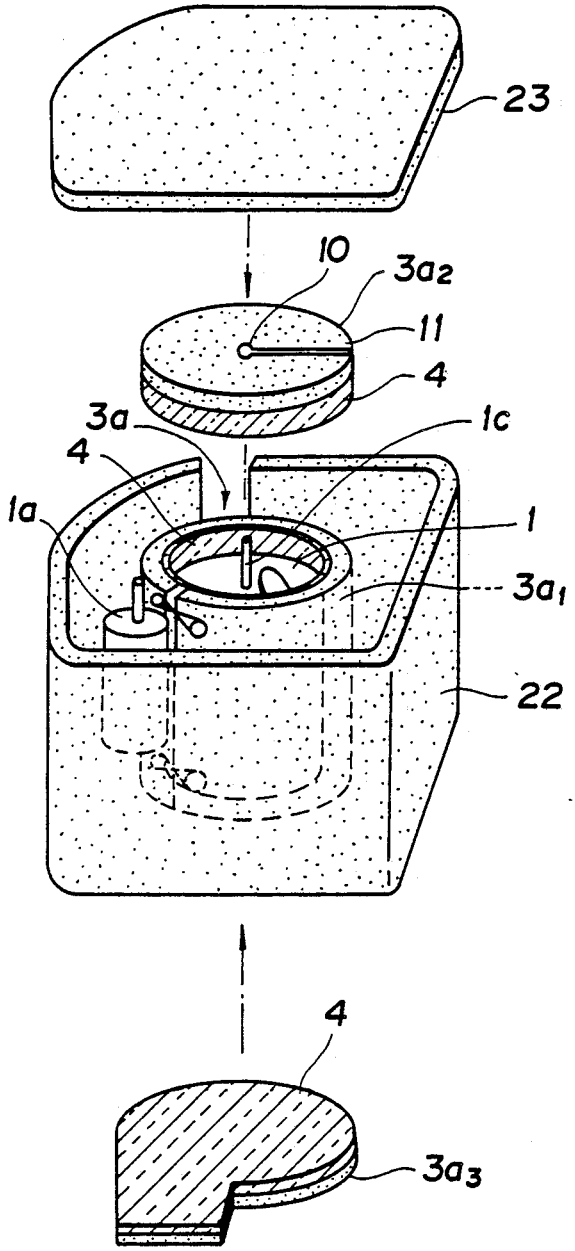
FIG. 6 is an exploded perspective view of another embodiment of the sound-proof cover of this invention.

FIG. 6 shows another embodiment according to this invention. In accordance with this embodiment, a sound-proof cover 3*a* has a main body $3a_1$ formed by being bent like a cylinder so as to be brought into close contact with outer peripheral portions (upper, lower and side surfaces) of the cylindrical portion of the casing 2 of the compressor 1 to cover the same, a lid cover $3a_2$ for closing an upper end opening of the main body $3a_1$, and a bottom cover $3a_3$ for closing a bottom opening of the main body $3a_1$.

Figure 7:
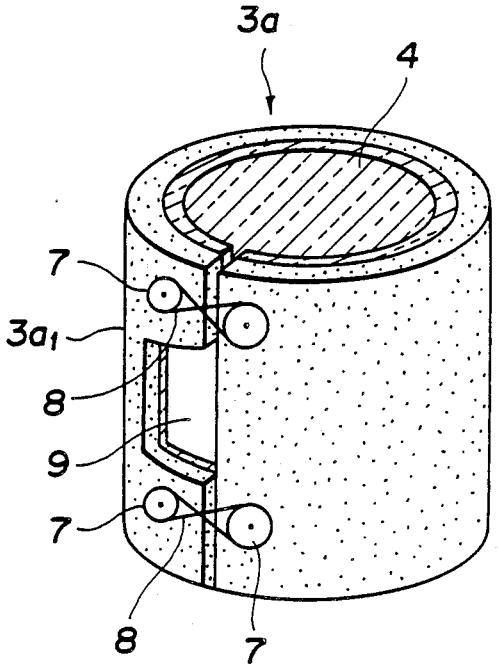
FIG. 7 is an enlarged perspective view of the sound-proof cover shown in FIG. 6.

The main body $3a_1$ is constructed in such a manner that, as also shown in FIG. 7, opposite ends of the bent cylindrical body are made to face each other to form the left-hand and right-hand sides with a certain gap formed therebetween, two pairs of left and right stop members 7 in the form of buttons are fixed to upper and lower portions of outer surfaces of the facing end portions, respectively, and a thin member 8 such as a string is wound in a crossing manner around each of the pairs of stop members 7 by being led generally to the right and left, thereby forming the main body $3a_1$ to have a cylindrical shape.

The main body $3a_1$ has a window 9 which is formed in one of its left and right facing end portions and through which a suction pipe of a suction cup 1*a* of the compressor 1 is passed.

A through hole 10 through which a discharge pipe 1*c* of the compressor 1 is passed is formed in the lid cover $3a_2$ at the center thereof. The through hole 10 communicates with a cut slit 11 formed by cutting the lid cover $3_2$ in a radial direction thereof.

Each of the main body $3a_1$, the lid cover $3a_2$ and the bottom cover $3a_2$ is constructed by successively placing a heat insulating member 4, a sound absorbing member 5 and a noise insulating member 6 one upon another as inner to outer layers and bonding these layers with an unillustrated adhesive, as shown in FIG. 2. The outer peripheral portions of the sound-proof cover 3*a* are covered with an outer cover 22 which is formed of a sound absorbing material 5 at desired distances from the sound-proof cover 3*a* in the radial direction, and upper end opening of the outer cover 22 is closed by an outer lid cover 23 formed of a sound absorbing member. The outer periphery of the casing 2 of the compressor 1 is thus doubly covered in order to reduce the magnitude of noise.

Each of the outer cover 22 and the outer lid cover 23 is formed of, for example, an urethane foam with a three-dimensional pattern of a wave-like irregularities such a that shown in FIG. 3 formed in the inner surface thereof.

Thus, in accordance with this embodiment, heat radiation from the outer peripheral surfaces of the casing 2 during operation of the compressor 1 is shut off by the heat insulating member 4, thereby enabling a reduction in the heat radiation loss of the compressor 1 and an improvement in the heat insulating performance.

It is therefore possible to reduce the power consumption during preheating of the compressor 1 and hence to improve the efficiency of heating operation as well as the starting characteristics thereof.

It is to be understood that this invention is not limited to the described embodiment, but many other changes or modifications can be made without departing from the spirit and scope of the appended claims.

What is claimed is:

1. An air conditioner comprising:

an outer casing in a form of a rectangular box;

a compressor accommodated in the outer casing;

an inverter operatively connected to the compressor for controlling an operation of the compressor;

a heat exchanging means disposed in the outer casing;

a fan means for circulating outdoor air into the casing of the air conditioner; and a sound-proof means surrounding said compressor and comprising a main body provided with inner and outer surfaces and a heat insulating member substantially covering the entire inner surface of the main body;

said heat insulating member having a heat transfer efficiency smaller than that of said main body, said main body being formed of a sound absorbing member laminated with a noise insulating member.

2. An air conditioner according to claim 1, wherein said sound absorbing member comprises a layer of urethane foam having a three dimensional pattern on a surface adjacent to the heat insulating member.

3. An air conditioner according to claim 1, wherein said sound absorbing member comprises a felt member.

4. An air conditioner according to claim 1, wherein said main body of said sound-proof means comprises a felt member and a noise insulating member, wherein said heat insulating member comprises a foam of a thermosetting resin, and wherein said foam of the thermosetting resin, said felt member and said noise insulating member are laminated and bonded to each other in this order with said foam of the thermosetting resin adjacent to an outer periphery of said compressor.

5. An air conditioner according to claim 1, wherein said sound-proof means comprises an upper portion constituting a lid cover of the compressor, a bottom portion constituting a bottom cover, and a side portion surrounding an outer side periphery of the compressor.

6. An air conditioner according to claim 5, wherein said side portion of the sound-proof means is formed in a flat plate like member which is foldable in a cylindrical shape wherein opposite side ends of said flat plate like member come together with a small gap therebetween to surround the outer side periphery of the compressor.

7. An air conditioner according to claim 6, wherein said sound-proof means is provided with a cutout at one of said side ends through which a suction cup of the compressor is inserted.

8. An air conditioner according to claim 1, wherein said sound-proof means is arranged in contact with substantially the entire outer surface of the compressor.

9. An air conditioner according to claim 1, wherein said sound-proof means is spaced from the outer surface of the compressor.

10. An air conditioner according to claim 1, wherein said heat insulating member is formed of a glass wool.

11. An air conditioner according to claim 1, wherein an outer cover formed of a sound absorbing material surrounds said sound-proof means.

12. An air conditioner according to claim 11, wherein said outer cover is formed of an upper portion, a bottom portion and a side portion so as to substantially entirely surround said sound-proof means.

* * * * *